US005371058A

United States Patent [19]

Wittig, Jr. et al.

[11] Patent Number: 5,371,058

[45] Date of Patent: Dec. 6, 1994

[54] ULTRAVIOLET PROTECTIVE COATINGS FOR APPLICATION TO HEAT SENSITIVE RECORD MATERIALS AND OTHER PHOTODEGRADABLE PRINTED MATTER

[75] Inventors: James T. Wittig, Jr., West Patterson, N.J.; Alfred Doi, 1820 E. Garry Ave. Suite 203, Santa Ana, Calif. 92705

[73] Assignee: Alfred Doi, Santa Ana, Calif.

[21] Appl. No.: 897,655

[22] Filed: Jun. 10, 1992

[51] Int. Cl.[5] ..... B41M 5/40

[52] U.S. Cl. ..... 503/206; 428/195; 428/203; 428/204; 428/211; 428/414; 428/423.1; 428/500; 428/520; 428/521; 428/532; 428/690; 428/913; 503/200; 503/226

[58] Field of Search ..... 503/200, 226, 206; 427/150–152; 428/537.5, 423.1, 520, 412, 535, 500, 522, 195, 203, 204, 211, 414, 521, 532, 690, 915

[56] References Cited

U.S. PATENT DOCUMENTS

| | | | |
|---|---|---|---|
| 3,442,682 | 5/1969 | Fukawa | 117/36.8 |
| 3,859,111 | 1/1975 | Takanishi | 117/36.8 |
| 3,871,065 | 3/1975 | Iomiyama | 117/36.8 |
| 3,983,279 | 9/1976 | Matsushita | 117/3.2 |
| 4,004,065 | 1/1977 | Matsushita | 428/532 |
| 4,484,204 | 11/1984 | Yamamoto | 346/200 |
| 4,609,612 | 9/1986 | Berner | 430/281 |
| 4,663,642 | 5/1987 | Kameda | 346/217 |
| 4,710,560 | 12/1987 | Vu | 528/67 |
| 4,886,774 | 12/1989 | Doi | 503/226 |
| 4,999,332 | 3/1991 | Okumura | 503/209 |
| 4,999,334 | 3/1991 | Mehta | 503/226 |
| 5,219,820 | 6/1993 | Morohoshi et al. | 503/204 |

FOREIGN PATENT DOCUMENTS

| | | | |
|---|---|---|---|
| 4003549 | 1/1979 | Japan | 503/226 |
| 0002945 | 1/1985 | Japan | 503/226 |
| 1284483 | 12/1986 | Japan | 503/226 |

OTHER PUBLICATIONS

Tinuvin 1130, Liquid Ultraviolet Light Absorber for Coatings, Ciba-Geigy Brochure, Ciba-Geigy Corp., 1987.

*Primary Examiner*—Pamela R. Schwartz
*Attorney, Agent, or Firm*—Stetina Brunda & Buyan

[57] ABSTRACT

Printing substrate materials (e.g., paper, cardboard, card stock, label stock, facsimile paper, thermally sensitive record materials, plastic film, et cetera . . . ) having at least one layer of an air dryable ultraviolet protective primer formed thereon. One or more layers of topcoat, such as a radiation curable topcoat, may be applied over top of the primer of the present invention to form a complete primer/topcoat system on the substrate material.

20 Claims, No Drawings

ULTRAVIOLET PROTECTIVE COATINGS FOR APPLICATION TO HEAT SENSITIVE RECORD MATERIALS AND OTHER PHOTODEGRADABLE PRINTED MATTER

FIELD OF THE INVENTION

The present invention relates to ultraviolet protective coatings for protecting heat sensitive record materials and other printed matter from the effects of ultraviolet radiation. More particularly, the present invention relates to an improved thermally dryable water based ultraviolet-protective primer applicable to heat sensitive record materials, papers, card stock, labels, cardboard and/or other printed matter. One or more layers of a topcoat (e.g. a radiation curable topcoat) may be applied over top of the primer of the present invention to impart additional ultraviolet protection, a glossy appearance and/or improved abrasion resistance.

BACKGROUND OF THE INVENTION

Many types of thermal printing papers or "thermally sensitive record materials" have been known in the prior art. Such thermally sensitive record materials typically comprise a base sheet of paper or similar material having a film-like heat sensitive record layer disposed thereon. The heat sensitive record layer generally contains dispersions of chemical materials which, upon application of heat and/or pressure to the record layer, will undergo a darkening or coloring reaction to result in the formation of a colored or darkened image on the record material.

The particular reactive chemicals contained in the heat sensitive record layer will generally dictate the type, density and color of the image formed therewithin.

Many heat sensitive record materials, including the majority of those used in commercial labeling applications, have record layers which contain a first reactive chemical known as a "color former", or color developer and a second reactive chemical known as a "dye precursor". The color former and dye precursor are capable of reacting with one another to form a desired colored image on the record material. The color former and dye precursor chemicals may be separately microencapsulated or otherwise separately contained so as to prevent casual mixing with one another as would likely result in the formation of a visible image on the record material. However, when the microencapsulation or other containment means is disrupted by the application of heat or pressure to the record layer, the dye precursor and color former chemicals contained therein will be permitted to flow together and react, thereby forming the desired visible image on the record layer. It is by such mechanism that thermal printing heads are utilized to form printed images on heat sensitive record materials.

Numerous types of dye precursors and color formers have been utilized in the heat sensitive record materials of the prior art. Prior to the image forming reaction, the color former(s) and dye precursor(s) remain inherently colorless (e.g. pale or white in color), when the image forming reaction takes place between the dye precursor(s), and becomes darkened in color, thereby forming the desired visual image. Accordingly, a group of light colored alkaline dye compounds known as "leuco" dyes are frequently employed as dye precursor components in the record layers of heat sensitive record materials. Examples of leuco compounds which may be usable for this purpose include: auramine leuco compounds, spiropyran leuco compounds, phenothiazine leuco compounds, fluoran leuco compounds, and triphenylmethane leuco compounds. In particular, the fluoran leuco compounds have the following general structural formula:

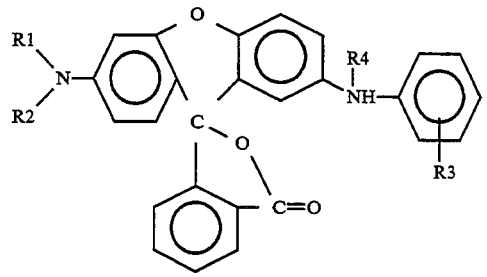

Where in $R_1$ and $R_2$ each represent an alkyl or cyclohexyl group, $R_3$ represents an alkyl group, haloalkyl group or a halogen atom and $R_4$ represents either hydrogen or an alkyl group.

The following compounds are examples of fluoran leuco dye precursors:

3-diethylamino-7-o-chloro-anilinofluoran;
3-diethylamino-7-m-chloro-anilinofluoran;
3-di-n-butylamino-7-o-chloro-anilino-fluoran;
2-(N-3'-trifluoromethylphenyl)amino-6-diethylamino-fluoran;
2-(N-3'trifluoromethylphenyl-N-methyl)amino-6-diethylaminofluoran; and
3-diethylamino-7-(3'trifluoromethylphenyl)amino-4'-chlorofluoran.

The color developers which combine with the leuco dye precursors to form the desired visual image include such compounds as phenolic compounds, sulfur compounds, esters, carboxylic acids, metal salts and amines. In particular, phenylthiourea color developer compounds of the following general structural formula are usable in connection with the various leuco dye precursors:

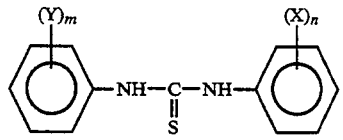

Where x and y each represent a halogen atom, alkyl group or a haloalkyl group, and m and n each represent an integer of 0 to 3.

The following compounds are specific examples of phenylthiourea color formers which may be used in connection with the various leuco dye precursors.

N,N'-diphenylthiourea;
4,4'-diethylphenylthiourea;
4,4'-diechlorophenylthiourea;
3,3'-dichlorophenylthiourea;
3,3'-dimethylphenylthiourea; and
3,3'ditrichloro-methylpehnylthiourea.

For purposes of illustration, a typical image forming reaction between a leuco dye precursor and a color former is shown herebelow:

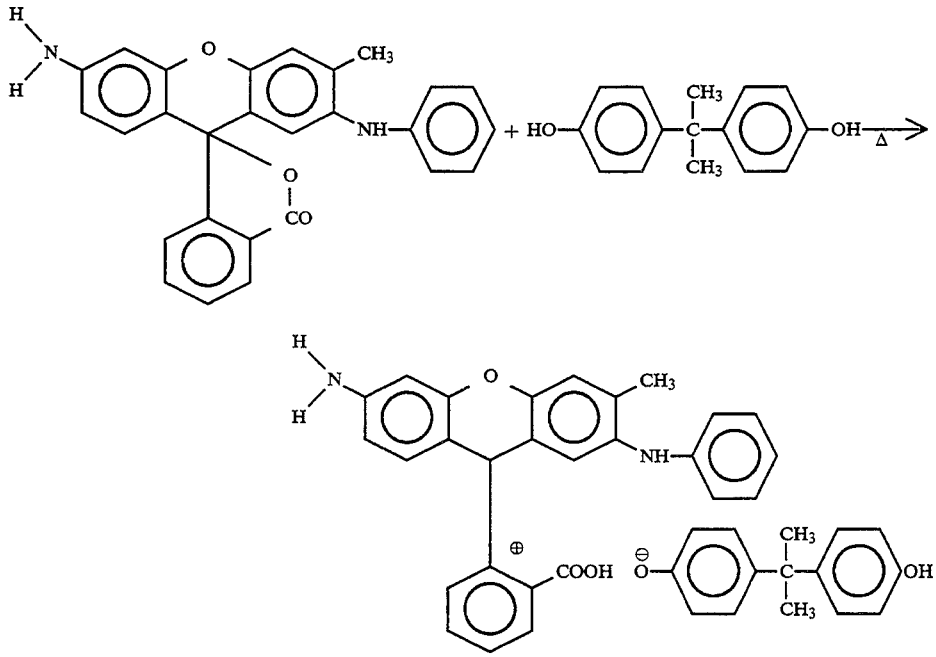

In addition to the image forming chemicals (e.g. the dye precursor and color former) the thermosensitive record layer may contain one or more binder agents, fillers, surfactants, and/or lubricants to minimize wear on the thermal head as the thermal head travels over the thermosensitive record layer.

One problem associated with thermosensitive record materials of the prior art is poor resistance to ultraviolet radiation. This poor resistance to ultraviolet radiation is manifested in two ways. First, the thermosensitive record layer tends to darken or yellow upon exposure to ultraviolet radiation. Second, thermally printed images formed on the thermosensitive record material tend to undergo fading or "photodegradation" when exposed to ultraviolet radiation. Both of these adverse effects of ultraviolet radiation represent functional drawbacks in the routine commercial usage of thermosensitive record materials in many commercial labeling and packaging applications.

Notably, product labels and inventory documents having optically readable bar codes formed thereon have become widely used in many commercial applications. However, the use of thermally sensitive record materials in the printing of such labels and documents has been inhibited due to the fact that darkening of the label and/or photodegradation of the bar code may sometimes result in diminished contrast between the bar code relative to the label background, thereby interfering with the routine optical scanning and reading of such bar codes.

Also, ultraviolet induced fading or photodegradation of printed images has been known to be exaggerated in printed articles wherein the image is formed of fluorescent dye or ink, as such fluorescent dyes or inks are known to be particularly susceptible to photodegradable or fading upon exposure to ultraviolet radiation.

In view of the above-described problems associated with the use of thermally sensitive record materials or ultraviolet sensitive materials in ultraviolet exposed applications, prior attempts have been made to provide ultraviolet protective overcoats which may be applied to paper, cardboard, label stock or thermally sensitive record material for the purpose of absorbing or preventing the transmission of ultraviolet radiation into the thermosensitive record layer.

Examples of ultraviolet protective overcoats for thermally sensitive record materials are found in U.S. Pat. Nos. 4,886,774 (Doi), 4,663,642 (Kameda, et al.) and 4,942,204 (Yamamoto, et al.).

Although the prior art has included some ultraviolet protective overcoats capable of protecting printed matter from the adverse effects of ultraviolet radiation, the application and curing of such ultraviolet protective overcoats of the prior art may be less than suitable for all types of printed matter and/or record material substitutes, due to the chemical content and/or processing requirements of such ultraviolet protective overcoats.

Accordingly, there remains a need in the art for improved ultraviolet protective overcoats capable of being applied to printing substrates such as paper, cardboard, plastic film, thermally sensitive record material, and the like, to prevent ultraviolet radiation from causing yellowing or darkening of the substrate and/or fading or degradation of words or images printed on the substrate without substantially increasing the time, expense or complexity of the manufacturing process.

SUMMARY OF THE INVENTION

The present invention provides an air-dryable ultraviolet-protective primer coating applicable to any type of printing substrate (e.g., paper, cardboard, thermally sensitive record material, label stock, facsimile paper, plastic film, et cetera . . . ) for the purpose of protecting the substrate from darkening or yellowing due to ultraviolet radiation and/or to prevent fading or degradation of printed or thermally formed images on said substrate.

In accordance with the invention, there is provided an air dryable ultraviolet protective primer for use on printing substrate materials, said primer generally comprising:

a) approximately 84–97 percent by weight aqueous borne polymer containing 25–60 percent by weight solids;

b) approximately 3–16 percent by weight ultraviolet absorber.

The aqueous borne polymer component may comprise solutions or emulsions. The ultraviolet absorber component may comprise any suitable ultraviolet absorbing, or ultraviolet inhibiting compound or material.

The air-dryable primer of the present invention may be applied to the substrate sheet in a plurality of coats or layers so as to provide an optimal degree of ultraviolet protection.

Further in accordance with the invention, one or more layers of topcoat or overcoating may be applied over top of the primer of the present invention to form a topcoat/primer system on the printing substrate material. Such topcoat may be radiation curable and, in particular, may be ultraviolet curable as the ultraviolet protection provided by the previously applied layer(s) of primer will prevent any ultraviolet radiation applied for curing of the topcoat from affecting the underlying printing substrate material and/or any images formed thereon.

Still further in accordance with the invention, there is provided a method of manufacturing an ultraviolet protected printing substrate material, said method including the step of applying at least one layer of an air-dryable primer of the present invention to the printing substrate material.

Further objects and advantages of the present invention will become apparent to those skilled in the art upon reading and understanding of the following detailed description and the accompanying examples.

DETAILED DESCRIPTION AND EXAMPLES OF PREFERRED EMBODIMENTS

The following detailed description of the present invention and the accompanying examples are provided for purposes of explaining and illustrating specific embodiments of the invention only, and are not intended to limit the scope of the invention in any way.

In accordance with the present invention, there is provided an air-dryable ultraviolet-protective primer coating applicable to thermally sensitive record materials to form an ultraviolet protective primer coat thereon. In some applications, such as facsimile paper applications, the primer coating of the present invention may be the only overcoating necessary to provide the desired range of protection from ultraviolet radiation, chemical invasion and/or mechanical abrasion. In other applications, such as labeling materials and the like, it will be desirable to apply one or more top coatings over the primer layer(s) of the present invention to enhance the resistivity of the material to ultraviolet, chemical and mechanical degradation, and/or to impart lubricity or sheen to the surface of the record material.

In accordance with the invention there is provided a particular radiation curable top coat or overcoat material which may be applied on top of one or more layers of the primer coating of the present invention to form a complete primer overcoat system for thermally sensitive record materials and/or printed matter, or ultraviolet sensitive printing substrates.

THE PRIMER OF THE PRESENT INVENTION

Broadly defined, the primer of the present invention comprises a water-borne emulsion of the following general formulation.

| Generic Formulation Component | % By Weight (Range |
|---|---|
| Aqueous Polymer Emulsion or solution | 84–97 |
| Ultraviolet Absorber | 3–16 |

The aqueous polymer component of the primer formulation may preferably comprise any suitable polymer emulsion and, in particular, may comprise acrylic polymer emulsions or solutions, aliphatic urethane polymer solutions, polyvinyl alcohol emulsions and/or polyvinyl acetate emulsions. In particular, one preferred polymer emulsion component of the formulation comprises a styrene-acrylic co-polymer emulsion ranging in molecular weight between 1600–40,000 and having a $T_g$ greater than 70° C. (Neocryl A-650 Emulsion, I.C.I., Wilmington, De.).

The ultraviolet absorber component of the primer formulation may preferably comprise any suitable ultraviolet absorbing compound including benzotriazoles, benzophenones and/or acetophenone derivatives. In particular, the ultraviolet absorber component of the primer may comprise one or more of the following compounds:

Tinuvin 1130 benzotriazole UV absorber (Ciba-Geigy, Hawthorne, N.J.);

Tinuvin 1130 constitutes a substituted hydroxyphenyl benzotriazole with two active U.V. absorbing components in polyethylene glycol as follows:

Poly (oxy-1,2-ethanediyl), a-(3-(3-(2H-benzotriazol-2-yl)-5-(1,1-diemthylethyl-4-hydroxyphenyl)-1-oxopropyl hydroxy; and . . . 52%

Poly (oxy-1,2-ethanediyl),a-hydroxyphenyl-1-oxopropyl-(3-(3-(2H-benzotriazole-2-yl) 5-(1,1-dimethylethyl)-4-hydroxypehnyl-1-oxopropoxy)-(3-(3-(2H-benzotriazole-2yl) 5-(1,1-dimethylethyl)-4- hydroxyphenyl-1-oxopropoxy) . . . 35% polyethylene glycol . . . 13%

Phenylformamidine e.g.n-(p-ethoxycarbonylphenyl)-n-methyl-n-phenyl formamidine);

Ethyl-2-cyano-3,3-diphenyl-acrylate;

Benzophenone derivatives e.g. (2-hydroxy-4-n-octyl oxybenzophenone).

PREPARATION AND APPLICATION OF THE PRIMER COATING OF THE PRESENT INVENTION

The primer of the present invention is applied to a substrate such as printing paper, cardboard, card stock, thermally sensitive material, label stock or other printing substrate material, in one or more applications so as to form one or more layers of primer thereon. It is preferable that each layer of primer be applied so as to have a wet thickness of approximately 0.2–0.5 mills. In some applications, it will be preferable that each layer of primer have a wet thickness of approximately 0.3 mills. Any suitable means of applying the primer to the substrate surface may be employed. One suitable means for applying the primer to the substrate is by way of a standard flexo printing press equipped with 150–200 line anilox rollers.

It is preferable that each layer of primer be permitted to air dry prior to subsequent application of another layer of primer or overcoat thereon. Multiple layers of primer may be applied, one on top of the other. The number of layers of primer to be applied will be determined on the basis of the degree of resistance to ultraviolet radiation and moisture desired.

After the primer coat(s) have been fully air dried, it may be desirable to apply one or more topcoats. Any suitable clear protective topcoat may be utilized, including the preferred topcoat of the present invention as described in detail herebelow.

A PREFERRED TOPCOAT OF THE PRESENT INVENTION

Preferred topcoats which may be applied over the primer of the present invention include those described and disclosed in U.S. Pat. No. 4,886,774 (Doi) entitled ULTRAVIOLET PROTECTIVE OVERCOAT FOR APPLICATION TO HEAT SENSITIVE RECORD MATERIALS, the entire disclosure of which U.S. Pat. No. 4,886,774 is expressly incorporated herein by reference.

A preferred topcoat of the present invention comprises an ultraviolet curable clear protective varnish of the following general formulation:

| Chemical Component | % By Weight | Acceptable Range (% by Weight) |
|---|---|---|
| Polyether aliphatic urethane diacrylate | 37 | 5–90 |
| Trimethylol propane triacrylate | 26 | 5–60 |
| 1-Hydroxycyclohexyl phenyl ketone | 6 | 1–10 |
| Triathanolamine | 3 | 1–10 |
| Silicone Acrylate | 2 | 1–10 |
| Substituted hydroxyphenyl benzotriazole UVA | 6 | 1–10 |
| 1,6-Hexanedinol diacrylate | 20 | 5–60 |

The polyether aliphatic urethane diacrylate component (component 1) of the above formulation may alternatively comprise any acrylate functional oligomer or acrylate soluble acrylic polymer.

The trimetholol propane triacrylate component (component 2) of the above formulation may alternatively comprise any multi-functional (e.g. di-, tri-, tetra-, penta-, or hexa functional) acrylate compound.

The 1-hydroxycyclohexyl phenyl ketone component (component 3) of the above formulation may alternatively comprise any other suitable photoinitiator capable of initiating the desired curing of the topcoat. Such alternative photoinitiators include the following:

4-methylbenzophenone;
2,4,6 -trimethylbenzophenone;
2-hydroxy-2-methyl-1-phenylpropanone;
oligo [hydroxy-2-methyl-1-4(1-methylvinyl)phenyl]-propanone;
Benzidimethyketal;
Thioxanthones [e.g. 2-isopropylthioxanthone];
Acethphenones [e.g. 2,2-diethoxyactophenone];
Amino Benzoates [e.g. ethyl 4-(di-methylamino)benzoate];
2,4,6 trimethylbenzoylddiphenoylphophine oxide; and
Aromatic Ketones [e.g. 1-hydroxycyclohexyl phenyl ketone].

The protective topcoat of the above-set-forth formulation forms a clear protective varnish when applied over top of one or more layers of the primer of the present invention. This topcoat provides enhanced protection from ultraviolet radiation as well as resistance to scuffing and scratching. Additionally, when fully cured, the topcoat of the present invention is sufficiently flexible to resist cracking when applied to a thermally sensitive paper at a thickness of 0.2 mills.

PREPARATION AND APPLICATION OF THE PREFERRED TOPCOAT

The topcoat of the present invention is a one-component coating which may be applied by any suitable means and subsequently cured by exposure to ultraviolet radiation within the 280–400 nm wave length range.

In applications where the topcoat is to be applied to a thermally sensitive record material it is important that one or more layers of the primer of the present invention be disposed on the thermally sensitive layer prior to application of the topcoat, as direct application of the topcoat to the thermal sensitive record layer may result in darkening and aberrant image formation on the record layer.

EXAMPLES

The following specific examples are provided to illustrate intended applications of the present invention. These examples are not intended to encompass all of the possible formulations and/or all of the possible applications of the present invention.

Example 1

Facsimile Paper

In this example, three (3) layers of the primer of the present invention are applied to a standard thermal sensitive facsimile paper substrate to prevent darkening of the paper and/or photodegradation of the facsimile image after exposure to ultraviolet radiation.

The specific formulation of the primer utilized in this example:

| Specific Name of Component | % By Weight |
|---|---|
| Neocryl A-650 Acrylic Emulsion (45% solid) (I.C.I., Wilmington, Delaware) | 84 |
| Tinuvin 1130 benzotriazol UV absorber (Ciba-Geigy, Hawthorne, N.J.) | 16 |

The primer is mixed well prior to use.

A first layer of primer is applied by 200 line anilox flexographic printing rollers to a wet thickness of approximately 0.3 mills. Warm air at a temperature of approximately 135° F. is passed over the first wet primer layer at a velocity of approximately 75 cfm to achieve drying thereof.

A second layer of primer is applied by the same method at the same thickness (i.e., approximately 0.3 mills) as the first layer thereof. The second primer layer is then dried by passing warm air at a temperature of approximately 125°–135° F. over the wet second primer layer at a velocity of approximately 75 cfm to achieve drying thereof.

In this example no overcoat or topcoat is applied on top of the primer layers.

The facsimile paper, having the two (2) primer layers thoroughly air dried thereon, is then rolled onto a standard roll so as to be loadable into a facsimile machine in a normal manner.

The Tinuvin 1130 benzotriazole ultraviolet absorber component of the primer coating serves to absorb ultraviolet radiation within the 280–400 nm. Thus, images formed in the thermosensitive record layer of the facsimile paper will be prevented from thermodegradation by ultraviolet radiation within such wave length range. Additionally, the facsimile paper itself will be protected from yellowing or darkening upon exposure to ultraviolet radiation within such wave length range.

EXAMPLE 2

Thermosensitive Label Stock

In this example a primer/topcoat system consisting of four (4) layers of primer and one (1) layer of topcoat is applied to a thermosensitive label material to form a thermally printed label which exhibits excellent resistance to the substrate darkening and/or image fading effects of ultraviolet radiation. Additionally, the preferred primer/topcoat system of this example provides (a) a high gloss surface appearance, (b) excellent surface lubricity to prevent excessive wear on thermal printing heads passing thereover and (c) resistance to mechanical scuffing and scratching.

The specific formulation of the air dryable primer utilized in this example is:

| Specific Chemical Component | % By Weight |
|---|---|
| Neocryl A-650 Acrylic Emulsion (45% solid) (I.C.I., Wilmington, Delaware) | 84 |
| Tinuvin 1130 benzotriazole UV absorber (Ciba-Geigy, Hawthorne, N.J.) | 16 |

The specific formulation of the radiation curable overcoat utilized in this example is:

| Specific Chemical Component | % By Weight |
|---|---|
| Abcure 2210 aliphatic urethane diacrylate (American Bilt Rite, Lawrenceville, N.J.) | 37 |
| Trimethylol propane triacetate (Sartomer, Westchester, PA) | 26 |
| 1-Hydroxycyclohexyl phenyl ketone (Ciba-Geigy Corp., N.J.) | 6 |
| Triethanolamine (Ashland Chemical (Ashland Chemical, Columbus, Ohio) | 3 |
| Ebercyl 350 silicone acrylate (UCB RadCure, Louisville, KY) | 2 |
| Tinuvin 1130 benzotriazole ultraviolet absorber (Ciba-Geigy, Hawthorne, N.J.) | 6 |
| 1,6,-Hexanediol diacrylate (Sartomer, Westchester, PA) | 20 |

A thermosensitive label stock substrate such as that commercially available as Kanzaki KL-360 (Kanzaki Specialty Paper, Inc., Ware, Mass.) is passed through a multi-station flexographic printing press at a fixed speed of approximately 100 ft. per minute.

Stations 1 through 4 of the press comprise 200 line anilox flexographic printing rollers for applying the primer formulation of this example at a wet thickness of approximately 0.3 mills. to the record surface of the passing label stock.

Thermal dryers, each operative to dispense warm air at a temperature of approximately 135° F., are positioned after each of the four (4) primer stations to effect substantial drying of each layer of primer prior to subsequent application of an additional layer of primer thereon.

Following application and drying of the four (4) 0.3 ml. thickness layers of primer on the thermal label stock, the thermal label stock proceeds at the fixed rate of 100 ft. per minute through a fifth station wherein the topcoat is applied by a 200 anilox metering roll to a wet thickness of approximately 0.2 mills. Two (2) three hundred watt ultraviolet lamp fixtures are positioned after the overcoat station to cast ultraviolet curing radiation on the wet topcoat layer as the label stock passes therebelow. Such 300 watt/in. ultraviolet lamps are sufficient to effect curing of a 0.2 ml. thick layer of the topcoat as the label stock passes at a rate of 100 ft./min.

Following application and air drying of the four (4) primer layers and application and ultraviolet radiation curing of the one (1) topcoat layer, the label stock is subjected to a thermal printing process whereby a thermal head is utilized to print labeling information and/or bar codes on the label stock.

The ultraviolet absorber component (e.g. Tinuvin 1130) of the primer coat serves to protect the label material for ultraviolet radiation induced darkening or yellowing and also serves to protect the words, images, other labeling information and/or bar codes printed thereon from the degradatory effects of ultraviolet radiation within the wave length range of 280–400.

The thermal label stock of this example may be maintained for long periods of time under natural outdoor conditions or under indoor fluorescent lighting (e.g., on a store shelf) without significant darkening or image degradation due to ultraviolet exposure.

The foregoing detailed descriptions and examples are provided for purposes of illustrating and explaining the invention only. Those skilled in the art will understand that various changes, additions, deletions and modifications may be made to the specific formulations and examples described herein without departing from the intended spirit and scope of the invention. Accordingly, it is intended that all such additions, deletions, modifications and alterations be included within the scope of the following claims and/or the equivalents thereof.

What is claimed is:

1. An ultraviolet protected heat sensitive record material comprising:

a heat sensitive substrate base sheet upon which an image may be thermally printed;

a coating of air dried ultraviolet protective primer disposed on said base sheet, said primer, at the time of wet application and prior to drying, comprising:

a) approximately 84–97 percent by weight aqueous borne polymer containing 25–60 percent by weight solids;

b) approximately 3–16 percent by weight ultraviolet absorber and;

at least one layer of radiation curable overcoat disposed over said at least one layer of primer.

2. The article of claim 1 wherein said base sheet comprises paper.

3. The article of claim 1 wherein said base sheet comprises cardboard.

4. The article of claim 1 wherein said base sheet comprises label stock.

5. The article of claim 1 wherein said base sheet comprises facsimile paper.

6. The article of claim 1 wherein said base sheet comprises plastic film.

7. The article of claim 1 wherein the aqueous polymer emulsion component of said primer is selected from the group consisting of:

Polyvinyl alcohol solution;
Polyurethane emulsion;
Latex emulsion;
Epoxy emulsion;
Hydroxyethylcellulose solution;
Styrene-butadiene copolymer emulsion;
Polyvinyl acetate emulsion;
Acrylic polymer emulsion;
Acrylic polymer solution, and;
Aliphatic polyurethane polymer emulsion.

8. The article of claim 1 wherein said emulsion comprises a styrene-acrylic copolymer emulsion ranging in molecular weight between 1600–40,000 and having a $T_g$ greater than 70° C.

9. The article of claim 1 wherein the ultraviolet absorber component of said primer is selected from the group consisting of:

benzotriazoles;
benzophenones;
acetophenones;
phenylformamidine;
n-(p-ethoxycarbonylphenyl)-n-methyl-n-phenyl formamidine);
ethyl-2-cyano-3,3-diphenyl acrylate;
2-hydroxy-4-n-octyloxybenzophenone, and;
Tinuvin 1130 (Ciba-Geigy, Hawthorne, N.Y.).

10. The article of claim 1 wherein said primer, prior to drying, comprises the following formulation:

approximately 84 percent by weight of a styrene-acrylic copolymer emulsion having a molecular weight between 1600–40,000 and a $T_g$ greater than 70° C.; and,
approximately 16 percent by weight of a benzotriazole ultraviolet absorber.

11. The article of claim 1 wherein said overcoat, at the time of wet application and prior to curing, comprises:

approximately 5–90 percent by weight polyether aliphatic urethane diacrylate;
approximately 5–60 percent by weight trimetholol-propane triacrylate;
approximately 1–10 percent by weight 1-hydroxycyclohexyl phenyl ketone;
approximately 1–10 percent by weight triethanolamine;
approximately 1–10 percent by weight silicone acrylate;
approximately 1–10 percent by weight substituted hydroxyphenyl benzotriazole; and
approximately 5–60 percent by weight 1,6-hexanediol diacrylate.

12. The article of claim 1 wherein said overcoat, at the time of application, comprises:

approximately 37 percent by weight polyether aliphatic urethane diacrylate;
approximately 26 percent by weight trimethylolpropane triacrylate;
approximately 6 percent by weight 1-hydroxycyclohexyl phenyl ketone;
approximately 3 percent by weight triethanolamine;
approximately 2 percent by weight silicone acrylate;
approximately 6 percent by weight substituted hydroxyphenyl benzotriazole; and
approximately 20 percent by weight 1,6-hexanediol diacrylate.

13. The article of claim 1 wherein the wet thickness of said primer on said base sheet is approximately 0.2–0.5 mil.

14. The article of claim 1 wherein the wet thickness of said primer on said base sheet is approximately 0.3 mil.

15. The article of claim 1 wherein said base sheet has at least one printed image formed thereon beneath said at least one layer of primer.

16. The article of claim 15 wherein said printed image comprises a bar code.

17. The article of claim 15 wherein said printed image comprises a fluorescent image printed in fluorescent ink.

18. The article of claim 15 wherein said base sheet comprises thermally sensitive record material and wherein at least one thermally formed image is formed on said base sheet beneath said at least one layer of primer.

19. The article of claim 1 wherein said coating of air-dryable ultraviolet protective primer comprises a plurality of layers of said primer applied consecutively, one on top of the other.

20. The article of claim 1 wherein said coating of air-dryable ultraviolet protective primer comprises 1–4 layers of said primer, said layers being applied one on top of the other.

* * * * *